United States Patent [19]

Belanger et al.

[11] 4,432,406

[45] Feb. 21, 1984

[54] POWER OPERATED BI-FOLD STRIP CURTAIN DOOR ASSEMBLY

[75] Inventors: James A. Belanger, Northville; Robert J. Wentworth, Ann Arbor; Douglas J. Calvin, Farmington Hills; James M. Lapham, Northville, all of Mich.

[73] Assignee: Belanger, Inc., Northville, Mich.

[21] Appl. No.: 260,952

[22] Filed: May 6, 1981

Related U.S. Application Data

[63] Continuation-in-part of Ser. No. 212,372, Dec. 3, 1980.

[51] Int. Cl.[3] ..... E05D 15/26

[52] U.S. Cl. ..... 160/199; 160/118

[58] Field of Search ..... 160/1–6, 160/118, 126, 199, 206, 207, 332

[56] References Cited

U.S. PATENT DOCUMENTS

| | | | |
|---|---|---|---|
| 687,035 | 11/1901 | Kinnean | 160/207 |
| 1,162,231 | 11/1915 | Fritz | 160/118 |
| 1,581,854 | 4/1926 | May | 160/199 |
| 1,758,600 | 5/1930 | Grassi | 160/199 |
| 1,949,224 | 2/1934 | Toelle | 160/126 |
| 1,963,321 | 6/1934 | Yowell | 160/118 |
| 2,895,728 | 7/1959 | Edelman | 160/118 |
| 3,614,975 | 10/1971 | Aymond | 160/118 |
| 4,289,190 | 9/1981 | Catan | 160/332 |

*Primary Examiner*—Peter M. Caun

*Attorney, Agent, or Firm*—Cullen, Sloman, Cantor, Grauer, Scott & Rutherford

[57] ABSTRACT

The power operated bi-fold strip curtain door assembly is well-suited for doorways and openings to conserve energy and has applications, as an example, in the car wash industry and in industrial plants. A pair of strip curtain supporting inboard and outboard sections are hinged together at next adjacent side edges in side-by-side relation. The inboard section of each pair is suspended from an overhead track by a carriage guidingly engaged with the track. A fluid power actuator is provided for each pair of sections and, when energized, operates to fold and extend the door sections to respectively open and close the door assembly. One of the door sections of each pair has a side edge strip curtain upper horizontal hem portion reinforced such that its vertical border portion extends laterally in the plane of the strip door section a predetermined distance therebeyond. With the two sections of each pair extended, the border portion is moved into overlapping flush relation to the neighboring strip curtain section providing a seal therebetween. Sensors, as an example, are located on one or both sides of the doorway for signaling the door actuators. Upon sensing the presence of a vehicle, the hinged sections of the door assembly automatically fold open avoiding contact with the vehicle, as the vehicle passes through the doorway.

7 Claims, 5 Drawing Figures

16
130
28
50
53
61
78
52
20
133
24
28
27
130
52
138
50
39
47
53
50
22
80
48
30
46
34
23
14
74
17
10
164
18
LIMIT SWITCH
DIRECTION OF
ROTATION
162
160
10
12
11
15

POWER OPERATED BI-FOLD STRIP CURTAIN DOOR ASSEMBLY

This application is a continuation-in-part application of our copending U.S. patent application, Ser. No. 212,372, filed Dec. 3, 1980, and having the same title.

BACKGROUND OF THE INVENTION

This invention relates to flexible strip curtain doors and more particularly to a power operated bi-fold strip curtain door.

Flexible strip curtain doors are finding ever increased use at open doorways to keep warm or cooled air inside the closed area. One problem with such strip curtain door installations is the application to vehicle access doorways wherein the plastic strips are subject to excess wear and damage by heavy traffic patterns found, for example, in car wash installations, enclosed parking garages, industrial plants, etc.

Thus, the invention herein relates to a flexible strip curtain power operated bi-fold vehicle door assembly which provides extended service life together with solving other problems and limitations of prior strip curtain doors.

SUMMARY OF THE INVENTION

The invention herein contemplates a power operated bi-folding strip curtain door assembly that insures against hot or cool air losses or energy losses at vehicle access doorways. The door comprises at least a pair of rigid folding inboard and outboard sections hinged together in a side-by-side manner. Each section supports a group of flexible hanging strip curtains in overlapping relation to each other. A feature of the invention resides in the juncture of adjacent groups of strip curtains being sealed by means of an overlapping flexible outermost strip that is reinforced along its upper horizontal edge. The outermost reinforced strip thus projects laterally in the plane defined by its associated curtain strips. Upon operation of the door actuator, the reinforced strip curtain border is moved into overlapped engagement with the outermost strip of a neighboring group of strip curtains so as to provide a seal therewith.

The sections are hinged together in side-by-side relation for movement between door forming unfolded or extended positions and door folded positions wherein the doorway is open. The inboard section is supported from an overhead track by a carriage. The outboard section is pivotally connected at its outermost end to an upright member defining one side of the doorway space. A cylinder and piston actuator has its blind and pivoted on the upright member with its piston rod free end pivoted to a mid portion of the adjacent outboard section.

Thus it is a feature of the present invention to provide a strip curtain bi-fold door assembly for use in a door space defined by an overhead track, a floor and a pair of spaced apart uprights, with the assembly comprising at least a pair of laterally positioned rigid inboard and outboard support sections hinged together at opposed adjacent ends by first hinge means, each of the support sections including means for suspending therefrom a group of elongated flexible strip curtains in overlapping relation adapted to close at least a part of the door space.

It is a further feature of the present invention to provide a strip curtain bi-fold door assembly of the aforementioned type wherein second hinge means are provided for connecting the free end of the outboard section to one of the uprights and carriage means are provided which are adapted to guidingly engage the track for travel therealong between the uprights, with the carriage means including pivot pin means for suspending the inboard section adjacent its free end from the track for pivotal movement during travel of the carriage means.

A still further feature of the present invention is to provide a strip curtain bi-fold door assembly of the aformentioned type wherein fluid actuator means are connected between the outboard section and the one upright for moving the sections and their associated groups of flexible strip curtains between an extended position across the door space and a folded position adjacent the one upright.

Another feature of the present invention is to provide a strip curtain bi-fold door assembly of the aforementioned type wherein regulating means are provided for supplying pressurized fluid for energizing the fluid actuator means; control means are provided for operating the regulating means including first switch means operating the actuator means causing the inboard and outboard sections to be moved to their folded position and including second switch means operating the actuator means causing the inboard and outboard sections to be moved to their extended position.

Still another feature is to provide a strip curtain bi-fold door assembly wherein the outboard section has a terminal strip curtain vertical border portion extending laterally a predetermined distance beyond the opposed adjacent end thereof and means reinforcing the upper horizontal edge of the terminal strip curtain so that its border portion is maintained in the plane of its associated group of strip curtains carried by the outboard section whereby upon the inboard and outboard sections being in an extended position the terminal strip curtain border portion overlaps the next adjacent terminal strip curtain of the inboard section such that a lap seal is provided at the juncture of the groups of flexible strip curtains.

A further feature of the present invention is to provide a bi-fold strip curtain door assembly wherein the inboard and outboard sections when in the folded position have a V-shaped configuration with first interior surfaces of the sections facing inwardly in opposing relation and second exterior surfaces of the sections facing outwardly, with the fluid actuator means being in the form of a piston and cylinder device, with the cylinder thereof having one end pivotally connected to the one upright and having an extensible and retractable piston rod extending from the other end thereof and being pivotally connected to an intermediate second surface portion of the outboard section whereby the axis of the cylinder and piston rod is disposed substantially parallel to the outboard section second surface when the sections are in either the folded position or the extended position.

Another feature is to provide a bi-fold strip curtain door assembly wherein the first switch means is responsive to the presence of a vehicle in the area adjacent one side of the door space thereby operating the actuator means causing the inboard and outboard sections to be moved to the folded position with the second switch means being responsive to the presence of the vehicle in the area adjacent the other side of the door space thereby operating the actuator means causing the inboard and outboard sections to be returned to their extended position.

Still another feature is to provide a bi-fold strip curtain door assembly wherein a second pair of inboard and outboard support sections are provided, the second pair supporting a group of elongated flexible strip curtains and being similarly mounted and arranged on the other upright and overhead track to provide double door assemblies operable simultaneously by control means to open and close the door space.

These and other features and advantages of the present invention will become apparent upon reading the following description, of which the attached drawings form a part.

DETAILED DESCRIPTION OF THE PREFERRED EMBODIMENT

Figure 2:
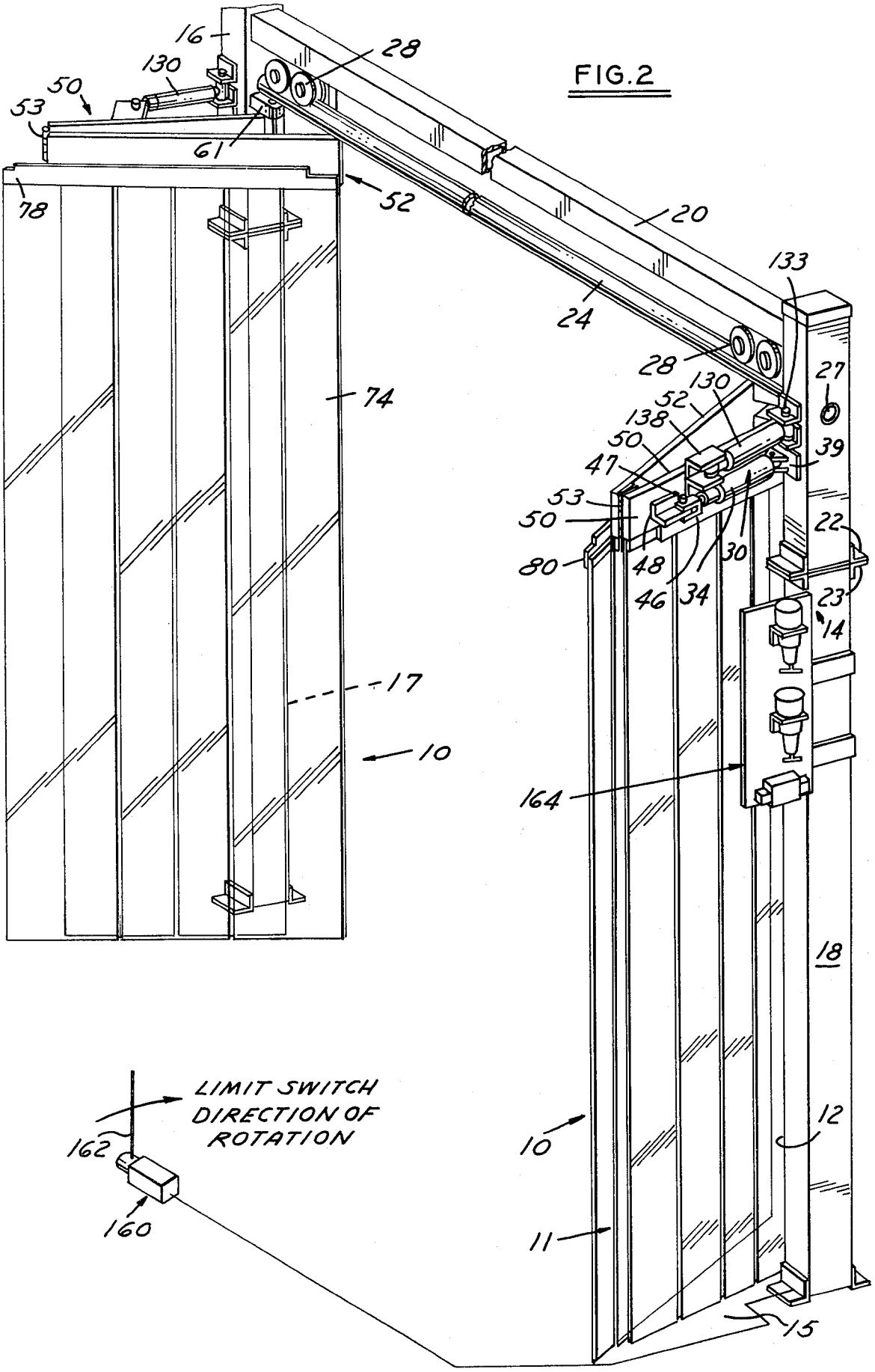
FIG. 2 is a perspective view of the bi-fold strip curtain door assembly, with parts broken away, and illustrating a pair of inboard and outboard door sections in a folded position.

Referring now to the drawings in detail, wherein like numerals indicate like or corresponding elements, there is illustrated in FIG.2 right and left hand bi-fold door assemblies generally indicated by the reference numeral 10. The door assemblies include bi-fold doors or door means 11, as an example in the form of strip curtains, closing a door space or opening 12 defined by an inverted U-shape frame 14 supported on the floor 15. The frame 14 is symmetrical and includes vertically disposed columns, door jambs, uprights, or upright members 18, and a horizontally disposed bridge portion, box header or header member 20 spanning the uprights 18. The uprights 18 and header 20 define access opening 12 enabling pedestrians or vehicles to pass through such opening.

Figure 4:
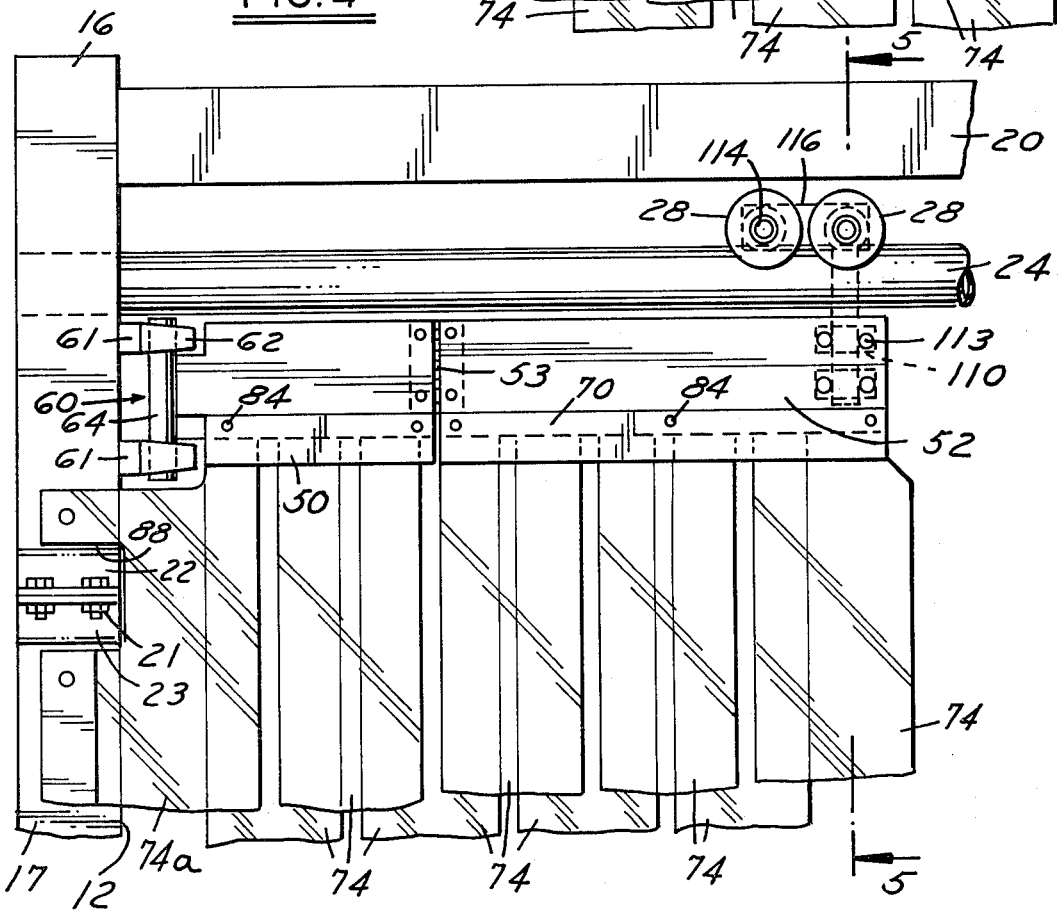
FIG. 4 is a fragmentary rear elevational view, with the protective shield removed, looking in the direction of arrow 4 of FIG. 1.

Each upright member 18 includes an upper member part 16 and a lower part member 17. The lower member part 17 is substantially longer than the upper member part 16. Each member part is tubular and is of rectangular configuration. The center member 20 is secured at each end to the upper member parts 16 (FIG. 2) by suitable means such as welding or by angle brackets not shown. The upper member part 16 is connected to the lower member part 17 by means of a pair of oppositely facing channel or angle brackets or clips 22, 23 which are bolted together by fasteners 21 which include bolts and nuts as shown in FIG. 4.

An elongated overhead track or track member 24 of generally circular cross section is supported beneath the header member 20 by the upper member part 16. The track member is co-extensive with the header member 20. The track 24 is in the form of a tube and has the free ends thereof extending through aligned apertures in each of the upper member parts 16. The outer ends of the tube or track 24 may be secured to the uprights by collars 27 or by other suitable means.

Each bi-fold door 11 is provided with a pair of guide rollers 28 which provides a carriage or carriage means for suspending the bi-fold door 11 from the track 24. Each guide roller 28 is provided with an annular concave recess 29 (FIG. 5) conforming with the track or tube 24 to allow rolling engagement therewith.

Figure 1:
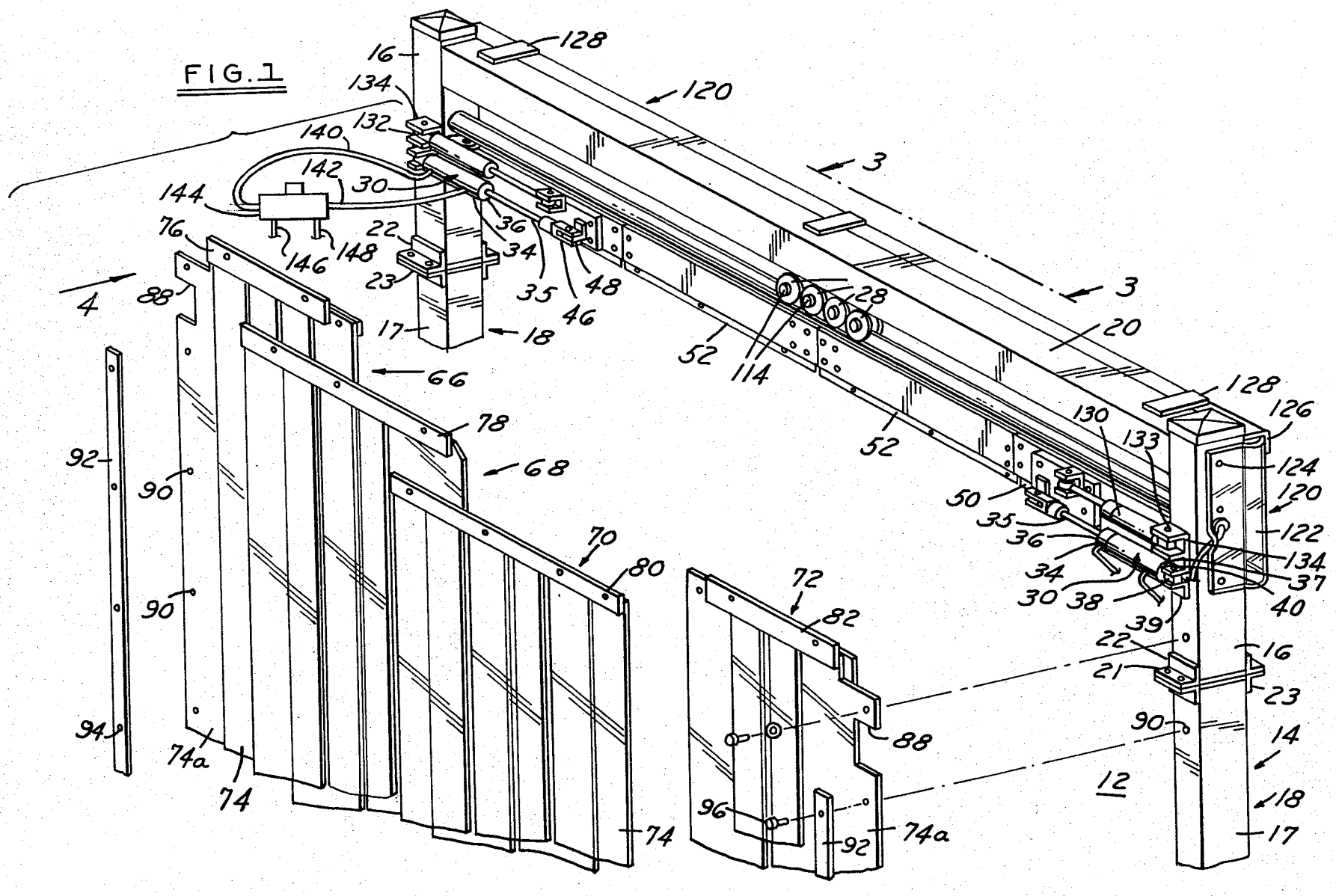
FIG. 1 is a fragmentary perspective view, with parts disassembled and broken away, of a power operated bi-fold strip curtain door assembly.

As illustrated in FIGS. 1 and 2, fluid powered linear door actuators generally indicated at 30 are provided on each side of the doorway 12 for each right and left hand door assembly 10. It is conceivable under certain circumstances that a single bi-fold door assembly would be sufficient to close the doorway opening 12 but the preferred embodiment of the present invention utilizes duplicate or double door assemblies 10, with one on each side of the doorway center line as best illustrated in FIG. 2.

It will be noted in FIG. 2 that the left hand door assembly 10 is a mirror image of the right hand door assembly 10 and the remaining parts are of the actuator means of actuators 30 and their controls are duplicates whether they are used on the left or right hand side of the door. Therefore, the same numbers will be used to represent duplicate parts of the bi-fold doors 11.

As best illustrated in FIGS. 1 and 2, the fluid actuator 30 in the preferred embodiment is a double-acting piston, not shown, reciprocally slidable within an operating cylinder 34. A piston rod 35 is connected on one end to the piston and extends outwardly through the end wall 36 of the cylinder 34. The other end of the piston rod 35 is pivotally attached to the bi-fold door 11 in a manner to be hereinafter discussed. The cylinder 34 is pivotally mounted at its opposite blind connected end 37 by means of an attached lug 38 joined to a suitable clevis or bracket 39 by a pin 40. The clevis 39 is anchored to one side (rear) of the upper member part 16. The free end of the rod 35 has a tab formed with an eye which is joined by a pin or other means 47 to a clevis 48. Clevis 48 is suitably fixed as by welding or by other means to one exterior face of the outboard section generally indicated at 50 to be subsequently described in greater detail.

Figure 5:
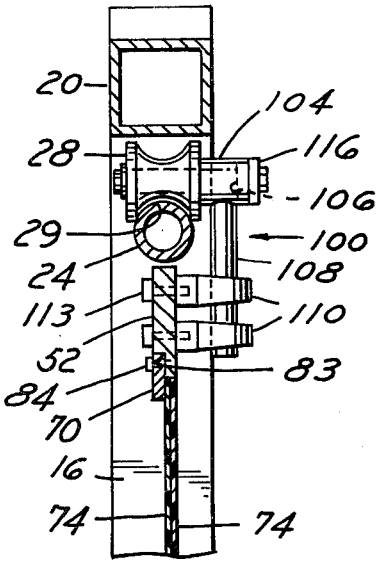
FIG. 5 is a sectional view taken on the line 5—5 of FIG. 4.

The bi-fold door 11 includes a laterally positioned of side-by-side outboard and inboard rigid door section 50 and 52 respectively which are hinged together at their opposed next adjacent ends by means of first hinge means in the form of a leaf hinge 53. Each of the outboard and inboard sections 50 and 52 are of generally rectangular configuration as shown in FIG. 5. Each section 50, 52 is made from a single piece of metal or may be made from sections or strips which are folded together to form a support for the strip curtains as will be later described.

The outermost ends of the outboard section 50 is pivotally connected to the upper member part 16 by a second hinge means in the form of a gate type hinge or pivot generally indicated at 60 (FIG. 4). The pivot 60 includes a pair of lugs 61 having a vertical bore 62. The lugs 61 are spaced vertically apart and are secured to the upper member part 16 (FIG. 4). The outer end of the outboard door section 50 carries a pivot pin or element 64, with the opposing ends thereof mounted in the lug 61 for rotation to permit the door assembly to fold to one side of the doorway 12 as best illustrated in FIG. 2.

The bi-fold door assemblies 11 include the curtain assemblies 66, 68, 70 and 72 are best illustrated in FIG.

1. Each curtain assembly includes a number of flexible elongated strips 74 which are appropriately supported by the inboard and outboard door sections 50 and 52. Each curtain assembly has an elongated reinforcing or mounting stay bar to which the upper edges of the corresponding elongated strips 74 are secured. Curtain assembly 66 includes stay bar 76; curtain assembly 68 includes stay bar 78; curtain assembly 70 includes stay bar 80; and curtain assembly 72 includes stay bar 82. FIG. 5 shows that the upper edges of the strip curtain 74 do not extend as high as the upper edge portion of the corresponding stay bar 70. The door section 52 has an undercut 83 which receives the stay bar 70 which is in turn secured to the section 52 by means of hanger machine bolts, rivets or fasteners 84.

Each of the elongated flexible strips 74 is preferably formed of flexible plastic material such as vinyl or polyvinyl chloride. The strips may be in different colors or be transparent or in any combination for safety purposes. Each strip is generally the same as its neighboring strips and may be provided in various widths with a typical strip 74 having a width of 12" and a thickness of 0.120". The strips 74 of each curtain assembly are arranged on the appropriate stay bar to overlap as is clearly illustrated in the drawings.

In the outboard section 50, the outermost strip **74*a* has its vertical edge at the upper end thereof notched at 88. In addition, the vertical edge portion of each strip 74*a* is provided with a plurality of punched holes 90 so that such edge may be secured to the adjacent post or member 17 by means of the elongated vertical stay bar 92, provided with corresponding openings 94. The stay bar 92 and strip 74*a* are secured to the adjacent post or column 17 by bolts or fasteners 96. The notch 88 permits the corresponding curtain assembly to be mounted around the mounting brackets or elements 22 and 23 as best illustrated in FIG. 4**.

In the preferred embodiments, the interior strips 74 fully and completely overlap adjacent strips as best illustrated in the several drawings.

As best shown in FIG. 2, the folding juncture of each bi-fold door 11 is defined by the hinge connection 53 interposed between the inboard and outboard door sections 52 and 50 respectively. The inboard section 52 of each bi-fold door 11 includes either the stay bar 78 or 80 which extends beyond the hinge 53 so as to provide a suitable overlapping strip seal for the adjacent outboard door section 50.

Figure 3:
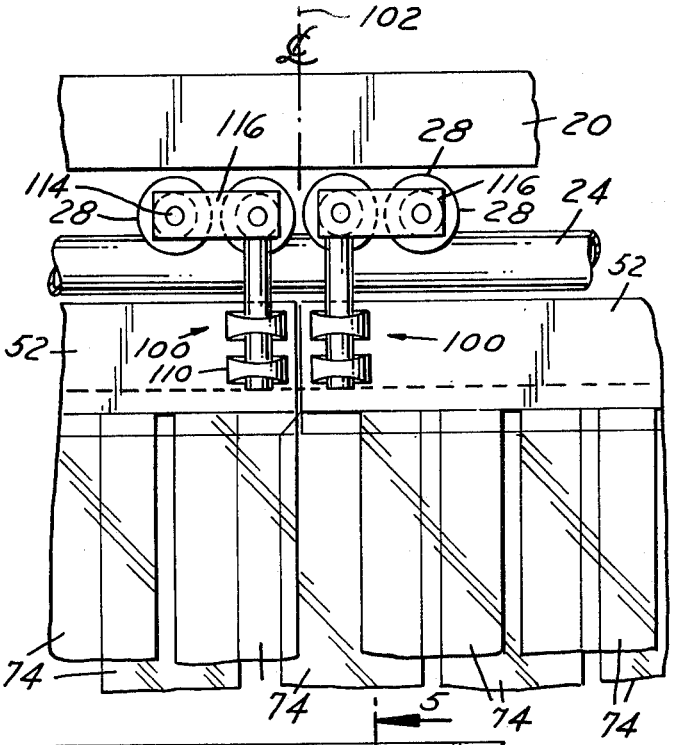
FIG. 3 is a fragmentary elevational view taken on the line 3—3 of FIG. 1, with the protective shield removed.

Each bi-fold door assembly 11 is supported from the single overhead track 24 by carriage means 100 (FIGS. 3 and 5) which includes the aforementioned pair of guide rollers 28. The guide roller 28 of each carriage means 100 closest to the center line 102 (FIG. 3) of the doorway 12 is provided with an axial stub shaft, mounting element and/or bushing 104 (FIG. 5) which has a vertical bore 106 for receiving the upstanding post or rod 108. The lower end portion of rod 108 is journaled in a pair of vertically spaced apart lugs or ears 110 which are carried by the inboard section 52 and secured thereto by suitable bolts or fasteners 113. The other roller 28 of each carriage means 100 also has a stub shaft and/or bushing 114. A connecting plate or bar 116 is carried by the shafts or supports of the associated rollers 28 of each carriage means 100 whereby the rollers 28 move together for tracking purposes upon opening and closing of the bi-fold door 11. Thus each bi-fold door 11 has a pair of suitable connected rollers 28, with one roller having an upstanding post or rod 108 which is secured to the inboard door section 52 (FIG. 3). A brace or bar 116 connects the rollers 28 together. Thus the two rollers 28 of each carriage means 100 move together simultaneously and in tandem and it has been found that the roller assembly tracks better than when using a single roller thereby eliminating the vibrations or the wiggling actions of the bi-fold door that has previously been encountered when using a single support roller.

In order to enclose and to protect the carriage means 100 and rollers 28 from dust and dirt a protective cover or shield 120 (FIG. 1) is supported on the header 20. The shield 120 includes end portions 122 secured to the side surfaces of each of the upper part members 16 by fasteners or bolts 124. A suitable mounting angle 126 and clips 128 are provided to assist in the mounting of the shield 120.

Each bi-fold door 11 is provided with a conventional direct acting shock absorber 130. The closed end of the cylinder has a lug 132 which is pivotably connected by a pin 113 to a bracket 134 carried by the upper part member 16 directly above the mounting for the corresponding actuator 30 as shown in FIGS. 1 and 2. The rod end 136 is journaled to the U-shaped bracket 138 in the usual manner well known in the shock absorber art. The purpose of each shock absorber 130 is to dampen the movement of the bi-fold door upon opening the door and closing the door.

With reference to FIGS. 1 and 2, it will be seen that the fluid actuator 30 is preferably in the form of an air actuated cylinder 32 with the opposite ends 36 and 37 of the air cylinder connected, as an example, by suitable air lines 140 and 142 to a control valve 144. A control arrangement is provided wherein the valve 144 is automatically operated to control the opening and closing of the bi-fold curtain doors 10. Thus, fluid such as air is fed from a pressure source by suitable conduits 146 and 148 into the front end of the cylinder 34 to thereby retract the piston rod 35 to the position shown in FIG. 2 wherein the door sections 50 and 52 are folded outwardly to form a "V" configuration to allow a vehicle to pass through the doorway 12. The actuator 30 causes the pair of guide rollers 28 to be rolled along the track 24 in a lateral outer direction towards upright 18 while the sections 50 and 52 are pivoted about their first hinge means 53 as shown in FIG. 2. The shock absorber 130 cushions the bi-fold door 11 upon the sections being folded into their V-shaped configuration. The shock absorbers 130 are self contained units such as used on automobiles and for other purposes. They dampen in both directions.

As stated above, it is within the contemplation of the invention that the bi-fold doors 10 can be operated automatically with the control valve or valves 144 including solenoid valve means to control the admission of fluid pressure to each of the cylinders 32. The doors 10 are operated automatically, for example, upon a vehicle entering the area adjacent the interior of the door space. Such an arrangement would further include an entrance limit switch and an exit limit switch 160, each switch being of the type having a feeler arm 162 engageable with the vehicle to establish an initial electrical signal to initiate operation of the solenoid controlled valve 144 as a vehicle enters the area, such as a car wash doorway within which the apparatus is installed. The vehicle would operate the limit switch to energize the valve 144 and cause the strip curtain door or doors 11 to be folded to their doorway open position as shown in FIG. 2. Further travel of the vehicle through the doorway causes the exit limit switch 160 (FIG. 2) to be energized through actuation of feeler arm 162 to cam along the vehicle body effecting operation of the control mechanism and reversal of the valve 144. This extends each piston rod 35 so as to move the bi-folding curtain door sections 50 and 52 to their extended doorway closed position as shown in FIGS. 3 and 4.

It is within the contemplation of the present invention that the actuator 30 could be single acting wherein compression spring means would normally urge the piston rod 35 into its extended position. With such an arrangement upon a malfunction, such as loss of pressurized fluid to the cylinder 32, the piston rod 35 would be extended by the spring biasing means whereby the bi-fold curtain door sections 50,52 would be moved to their doorway closed position.

The pneumatic circuit for the fluid cylinders or actuators 30 includes a regulator panel assembly 164 mounted on one upright member 18. The aforementioned air lines or conduits are suitably connected to the regulator panel assembly 164 and to an air filter, not shown, as is well known in the pneumatic field.

We claim:

1. A strip curtain bi-fold door assembly adapted for use in a door space defined by an overhead track, a floor and a pair of spaced apart uprights, said door assembly comprising:

at least a pair of laterally positioned inboard and outboard door means having opposed adjacent ends and free ends for closing at least a part of the door space, each said door means including support means for suspending a group of elongated flexible strip curtains in overlapping relation;

first hinge means for connecting the opposed adjacent ends of said door means;

second hinge means adapted to connect the free end of the outboard door means to one of the uprights;

carriage means adapted to guidingly engage the track for travel therealong;

said carriage means including a pivot pin means adapted for suspending the inboard door means adjacent its free end for pivotal movement during travel of said carriage means;

fluid actuator means adapted to be interconnected between one of said door means and said one upright and effective when actuated to move said door means and their associated group of strip curtains between a folded position adjacent said one upright and an extended side-by-side position across the door space;

said fluid actuator means being in the form of a piston and cylinder having one end pivotally connected to said one upright and an extensible and retractable piston rod extending from said cylinder other end with the rod pivotally connected to said outboard door means;

said carriage means further including a first roller having an annular groove which conforms to and receives said track, said roller having a stub shaft rotatably supporting said pivot pin means;

one of said door means having a terminal exterior strip curtain vertical border portion extending laterally a predetermined distance beyond the associated opposed adjacent end of said one door means;

means reinforcing the upper horizontal edge of said terminal exterior strip curtain such that its border portion is maintained in the plane of the associated group of strip curtains carried by said one door means;

wherein upon said door means being extended said terminal exterior strip curtain border portion overlapping the next adjacent strip curtain of the other door means such that a lap seal is provided at the juncture of said outboard and inboard groups of curtain strips;

said door means in their folded position having a V-shaped configuration with first interior surfaces of said door means facing inwardly in opposed relation, and second exterior surfaces of said door means facing outwardly;

the axis of said actuator being disposed substantially parallel to said outboard door means when said door means are in either said folded position of said extended position; and a shock absorber being connected between said outboard door means and said one upright to dampen the vibrations upon the folding or opening of said inboard and outboard door means and their associated groups of strip curtains.

2. The assembly as defined in claim 1 wherein:

regulating means are provided for supplying pressurized fluid for energizing said actuator means;

control means for said regulating means including first switch means operating said actuator means causing said door means to be moved to their folded position; and said control means including second switch means operating said actuator means causing said door means to be moved to their extended position.

3. The assembly as defined in claim 2 wherein:

said first switch means being responsive to the presence of a vehicle in the area adjacent one side of said door space thereby operating said actuator means causing said door means to be moved to their folded position; and said second switch means being responsive to the presence of the vehicle in the area adjacent the other side of the door space thereby operating said actuator means causing said door means to be returned to said extended position.

4. The assembly as defined in claim 1 having a second pair of door means, each supporting a group of elongated flexible strip curtains, said second pair of door means similarly mounted and arranged on the other upright and overhead track to provide double door assemblies operable by said control means to open and close the door space.

5. The assembly as defined in claim 1 wherein:

said carriage means including a second grooved roller engageable with said track, said second roller having a stub shaft; and means connecting the stub shaft of said second roller to the stub shaft of the first roller whereby said second roller assists the first roller in its movement along said track.

6. The assembly as defined in claim 1 wherein each upright member comprises an upper member part and a lower member part, the opposing ends of said parts being joined by connecting plates which are bolted together, said track being of circular configuration.

7. The assembly as defined in claim 6 wherein said fluid actuator means being pivotally connected to the upper member part of the corresponding upright member.

* * * * *